US006877328B2

(12) United States Patent
Bair, III et al.

(10) Patent No.: US 6,877,328 B2
(45) Date of Patent: Apr. 12, 2005

(54) COMPRESSOR OPERATION FOLLOWING SENSOR FAILURE

(75) Inventors: Richard H. Bair, III, Weaverville, NC (US); Bryan M. Elwood, Candler, NC (US)

(73) Assignee: Kendro Laboratory Products, LP, Asheville, NC (US)

( * ) Notice: Subject to any disclaimer, the term of this patent is extended or adjusted under 35 U.S.C. 154(b) by 0 days.

(21) Appl. No.: 10/420,754

(22) Filed: Apr. 23, 2003

(65) Prior Publication Data

US 2004/0211198 A1 Oct. 28, 2004

(51) Int. Cl.[7] ..... F25B 49/02

(52) U.S. Cl. ..... 62/126; 62/155; 62/158; 62/131; 62/228.1

(58) Field of Search ..... 62/125, 126, 127, 62/129, 130, 228.1, 228.3, 155, 158, 131; 700/79, 80, 82, 276, 278

(56) References Cited

U.S. PATENT DOCUMENTS

| | | | | | |
|---|---|---|---|---|---|
| 4,142,375 | A | * | 3/1979 | Abe et al. | 62/158 |
| 4,432,210 | A | * | 2/1984 | Saito | 62/126 |
| 4,750,332 | A | * | 6/1988 | Jenski et al. | 62/80 |
| 4,821,528 | A | * | 4/1989 | Tershak | 62/228.1 |
| 4,936,105 | A | * | 6/1990 | Takechi et al. | 62/129 |
| 5,115,643 | A | * | 5/1992 | Hayata et al. | 62/115 |
| 5,123,252 | A | * | 6/1992 | Hanson | 62/89 |
| 5,276,630 | A | * | 1/1994 | Baldwin et al. | 700/276 |
| 5,564,285 | A | | 10/1996 | Jurewicz et al. | 62/127 |
| 6,438,973 | B1 | | 8/2002 | Yoshida et al. | 62/126 |
| 2001/0049942 | A1 | | 12/2001 | Pham et al. | 62/126 |
| 2002/0157821 | A1 | | 10/2002 | Beitelmal et al. | 165/206 |
| 2002/0184905 | A1 | | 12/2002 | Benedict et al. | 62/228.4 |

FOREIGN PATENT DOCUMENTS

| | | |
|---|---|---|
| EP | 0 453 302 | 10/1991 |

* cited by examiner

*Primary Examiner*—Harry B. Tanner
(74) *Attorney, Agent, or Firm*—Baker & Hostetler LLP

(57) ABSTRACT

A compressor is controlled by generating and storing a compressor operation log. In addition, a compressor operation is selected from the compressor operation log in response to a sensor failure. Furthermore, the compressor is modulated according to the selected compressor operation in response to the sensor failure.

24 Claims, 2 Drawing Sheets

COMPRESSOR OPERATION FOLLOWING SENSOR FAILURE

FIELD OF INVENTION

The present invention relates generally to refrigeration systems. More particularly, the present invention relates to a compressor operation in response to sensor failure in a refrigeration system.

BACKGROUND OF THE INVENTION

In refrigeration systems, a refrigerant gas is compressed in a compressor unit. Heat generated by the compression is then removed generally by passing the compressed gas through a water or air cooled condenser coil. The cooled, condensed gas is then allowed to rapidly expand into an evaporator coil where the gas becomes much colder, thus cooling the coil and the inside of the refrigeration system box around which the coil is placed.

Life Science researchers have a need for ultra low temperature ("ULT") storage chambers to store products such as living organisms, biologically active reagents, and the like. As these products may die or become biologically inactive when improperly warmed, these researchers also need to minimize any product warm-up. In this regard, generally, sensors are utilized to determine whether the inside of the refrigeration system box or cabinet is within a predetermined temperature range. In response to sensed temperatures being outside this predetermined temperature range, a controller typically modulates the compressor to effect an appropriate temperature change. For example, if the temperature rises above the predetermined temperature range, the controller may modulate the compressor to turn on or increase speed.

A problem, which has arisen with such ULT freezers, is that when the sensor fails, the controller may improperly modulate the compressor and the temperature may deviate outside the predetermined temperature range. Known ULT freezers typically include an alert system designed to notify a user of potential problems. Often, these freezers also include a default operation. This default operation is generally only appropriate for a relatively narrow range of operating conditions. As these ULT freezers are commonly located in remote areas, the alert system may go un-noticed for an extended period of time. Thus, if the operational conditions are outside the relatively narrow range for which the default operation is optimized, the temperature may deviate outside the predetermined temperature range and the contents of the ULT freezer may be destroyed.

In addition, temperature deviations outside the predetermined temperature range are not only undesirable for the contents, but lowering the temperature below the predetermined temperature range places increased loads on the refrigeration unit as it must operate on a more continuous basis than it was designed. This increased load may decrease compressor life or cause compressor failure.

The present invention overcomes the above mentioned disadvantages to a great extent, and provides many additional advantages which shall become apparent as described below.

SUMMARY OF THE INVENTION

It is therefore a feature of the present invention to provide method of controlling a compressor. In this method, a compressor operation log is generated and stored. In addition, a compressor operation is selected from the compressor operation log in response to a sensor failure. Furthermore, the compressor is modulated according to the selected compressor operation in response to the sensor failure.

Another feature of the present invention pertains to an apparatus for controlling a compressor. This apparatus includes a refrigerant compressor and a memory configured to store compressor data associated with controlling the compressor. In addition, the apparatus includes a first sensor configured to transmit measurements associated with environmental conditions within a cabinet and a controller operatively connected to the compressor, the memory, and the first sensor. Furthermore, in response to a failure of the first sensor, the controller is configured to modulate the compressor according to the compressor data.

Yet another feature of the present invention relates to an apparatus for controlling a compressor. This apparatus includes a means for generating and storing a compressor operation log. In addition, the apparatus includes a means for selecting a compressor operation in response to a sensor failure. This compressor operation is selected from the compressor operation log. The apparatus further includes a means for modulating the compressor according to the selected compressor operation in response to the sensor failure.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purposes of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

DETAILED DESCRIPTION OF PREFERRED EMBODIMENTS OF THE INVENTION

Figure 1:
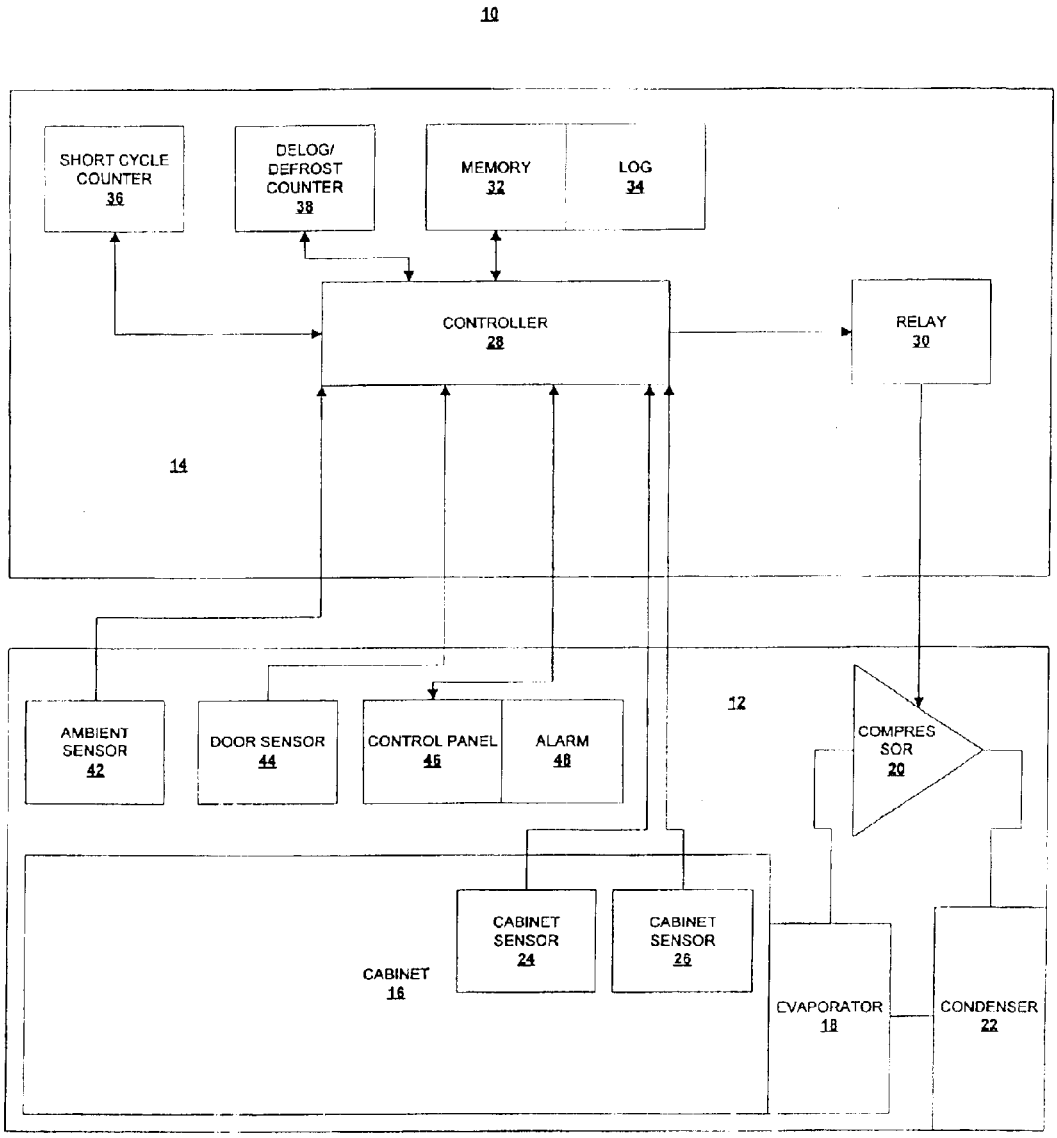
FIG. 1 is a system architecture according to an embodiment of the present invention.

Referring now to the Figures, in FIG. 1 there is shown a system architecture of a freezer unit 10 according to an embodiment of the invention. The freezer unit 10 includes a freezer sub-unit 12 and a control system 14. The freezer sub-unit 12 includes a cabinet 16 configured to provide a refrigerated storage volume. In this regard, the cabinet 16 is cooled by the action of refrigerant evaporating in an evaporator 18. This evaporator 18 may be located with the cabinet 16 or, more preferably, thermally attached to the cabinet 16. For example, the evaporator 18 may be attached to the cabinet 16 via a thermally conductive material such as metal. In a preferred embodiment, the refrigerant is compressed by a compressor 20 and condensed in a condenser 22.

The freezer sub-unit 12 further includes at least one cabinet sensor 24. The cabinet sensor 24 senses environmental conditions within the cabinet 16. For example, the cabinet sensor 24 may sense at least one of temperature, humidity, frost buildup, and the like. The freezer sub-unit 12 may, optionally, also include another cabinet sensor 26. This cabinet sensor 26 may be utilized in conjunction with the cabinet sensor 24, for example, to determine an average environmental condition and/or confirm measurements of the cabinet sensor 24. In addition, the cabinet sensor 26 may serve as a backup sensor in the event of primary sensor failure, for example, failure of the cabinet sensor 24.

The freezer unit 10 is configured to substantially maintain the temperature of the interior of the cabinet 16 within a predetermined range of a set temperature ("$T_{set}$"). In this regard, the control system 14 includes a controller 28 configured to control the compressor 20 via a relay 30. This controller 28 is further configured to receive measurements or signals from the cabinet sensors 24 and/or 26 and modulate the operation of the compressor 20 in response to the received measurements. In this manner, the temperature of the interior of the cabinet 16 may be substantially maintained within a predetermined range of the $T_{set}$.

Additionally, the control system 14 includes a memory 32 operable to store and retrieve data for the controller 28. In a preferred embodiment of the invention, compressor operations such as duty cycles, time on, time off, speed, pressures, and the like are stored to the memory 32 in the form of a compressor log ("log") 34. This log 34 preferably includes a chronologically ordered list of compressor operations. In the event of a sensor failure, the controller 28 is configured to access the memory 32 and retrieve a relatively recently stored compressor operation ("logged operation") from the log 34. Generally, conditions such as payload within the cabinet 16 and ambient temperature are likely to be similar to those conditions experienced recently. Thus, a compressor operation utilized to control the compressor 20 during recently experienced conditions may more closely approximate actual conditions than a default operation.

The controller 28 may further be configured to evaluate the logged operation. For example, the logged operation may be compared to a predetermined range of compressor operations and if the logged operation is outside of this predetermined range, another compressor operation may be utilized. This predetermined range of compressor operations preferably includes compressor operations for essentially all reasonable conditions. In a specific example, a duty cycle having an on:off ratio between 2:1 and 7:1 may reasonably be expected to maintain the cabinet 16 at the $T_{set}$. Thus, if the logged operation falls outside this predetermined range, a default duty cycle of 20 minutes on, 8 minutes off (2.5:1) is employed in this example. The default duty cycle is only used after a determination that data in the log is deemed inappropriate or in error and provides a second level of redundancy. The default mode of operation may be determined via targeting a specific cabinet temperature operating in relatively severe ambient conditions. In an embodiment of the invention, the controller 28 is configured to access the log 34 in reverse chronological order and evaluate each logged operation until a logged operation within the predetermined range of compressor operations is identified. The controller 28 is further configured to utilize a default compressor operation if a logged operation within the predetermined range of compressor operations is not identified. Moreover, the memory 32 may store and retrieve a variety data types such as default compressor operations, predetermined range of compressor operations, ambient environmental conditions, set temperatures, door events, and the like.

In a preferred embodiment of the invention, control system 14 further includes a plurality of counters 36 and 38 that are configured to initiate a plurality of respective compressor operations. This plurality of counters includes a short cycle counter 36 and a delog/defrost counter 38. Each time the compressor 20 is turned on or off, the short cycle counter 36 is configured to initiate counting down from a predetermined value ("$short_{count}$"). This $short_{count}$ has been empirically determined to provide sufficient time for excessive head pressure to dissipate from the compressor 20. The controller 28 is configured to reference the short cycle counter 36 to determine if sufficient time has elapsed to modulate the compressor 20.

The delog/defrost counter 38 may be configured to initiate a delog/defrost operation in response to a predetermined elapsed period ("$delog/defrost_{count}$") since a previous delog/defrost period having been executed. This $delog/defrost_{count}$ is reset at the end of the current delog/defrost cycle. If the compressor 20 remains on and/or within a duty cycle for a period exceeding a predetermined delog/defrost period, the delog/defrost counter 38 is configured to initiate a delog/defrost cycle for the compressor 20. At an operational minimum, the delog/defrost counter 38 will call for a delog/defrost cycle. For example, an attempt to initiate a delog/defrost cycle at the minimum point of a temperature cycle. In addition or alternatively, if the compressor 20 remains on for a period exceeding a predetermined delog period, the delog/defrost counter 38 is configured to initiate a delog or rest period for the compressor 20. This rest period following the $delog/defrost_{count}$ has been empirically determined to provide an opportunity for oil within the compressor 28 to liquefy and thereby extend the useful life of the oil. In some instances, particularly defrost scenarios, control of ice formation may be the objective of the compressor rest period. In a specific example, the delog/defrost counter 38 may initiate a 10 minute "off" period in response to the compressor 20 being on and/or in a duty cycle for 8 hours. In this way, a rest period of a duration long enough to protect the system oil is essentially assured.

In this and/or various other embodiments of the invention, the freezer sub-unit 12 may include an ambient sensor 42, a door sensor 44, and a control panel 46 having an alarm 48. The controller 28 is configured to receive signals from the ambient sensor 42 and the door sensor 44. The controller 28 is further configured to associate signals received from the ambient sensor 42 and the door sensor 44 with compressor operations and store these signals to the log 34. In this manner, ambient environmental conditions and door open and/or close events may serve to initiate compressor operations. This data may also be appended to the log 34 in order to aid in determination of a compressor duty cycle to employ in the event no temperature feedback is provided due to one or more failed sensor(s).

The control panel 46 is configured to provide a user the capability to enter information such as the $T_{set}$ and the like. In this regard, the control panel 46 and the controller 28 are operable to intercommunicate. Additionally, the controller 28 is configured to initiate an alarm state in response to a detected failure. For example, if the cabinet sensor 24 and/or 26 fail, the controller 28 may initiate the alarm state and the alarm 48 may emit a visual and/or auditory warning. Furthermore, this alarm state may include transmitting a signal to a network connection.

Figure 2:
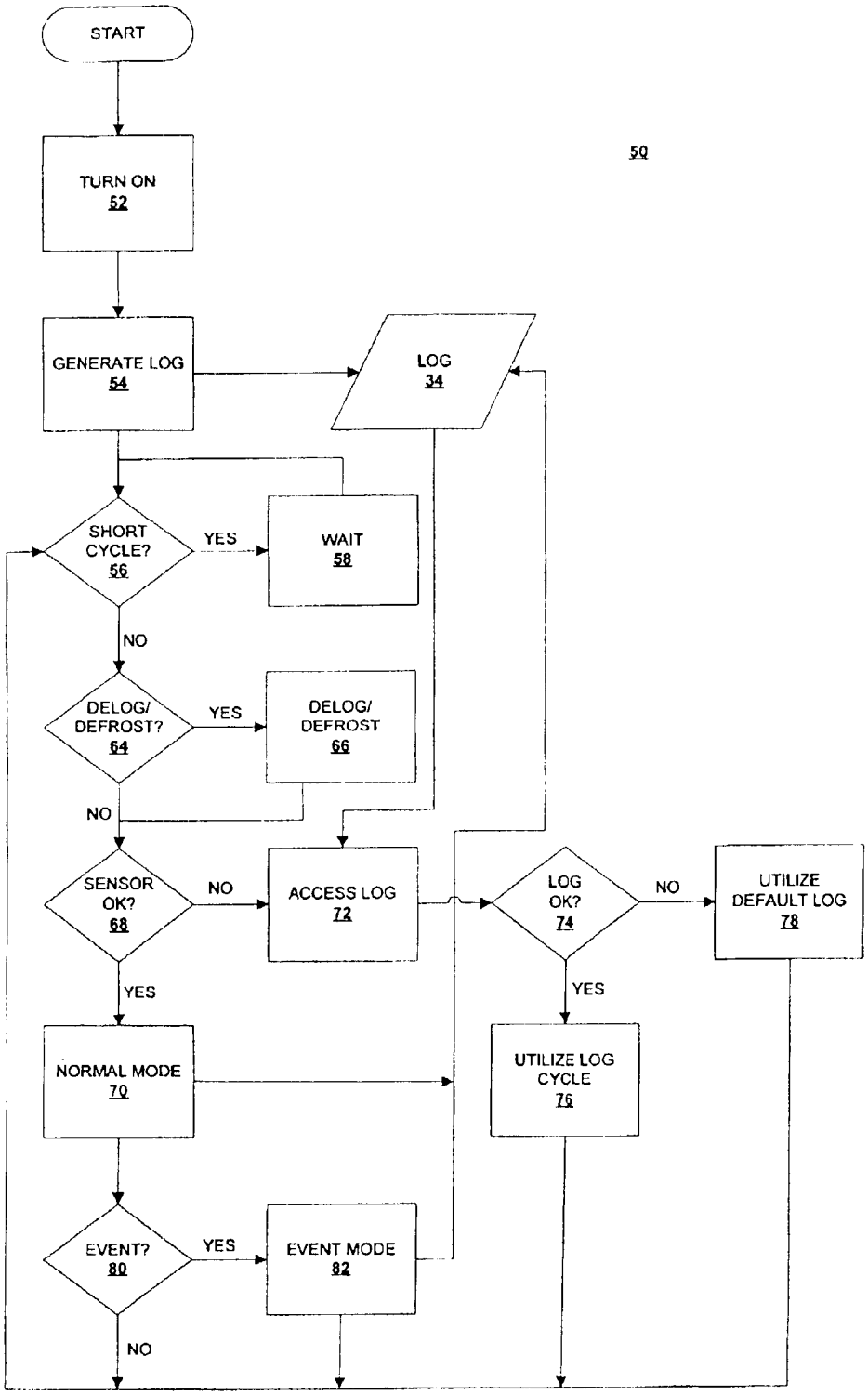
FIG. 2 is a flow diagram according to an embodiment of the present invention.

Referring now to FIG. 2, there is illustrated a method 50 of controlling the freezer unit 10 according to an embodiment of the invention. As shown in FIG. 2, the method 50 may be initiated in response to the freezer unit 10 being turned on at step 52. At step 54, the log 34 may be generated and stored to the memory 32.

At step 56, it is determined if sufficient time has elapsed to facilitate a sufficient drop in head pressure within the compressor 20. For example, the short cycle counter 36 may be referenced and if sufficient time has not elapsed, the controller 28 may wait at step 58 until sufficient time has elapsed. If sufficient time has elapsed, it is determined if it is time to perform a delog/defrost cycle at step 64. For example, the controller 28 may refer to the delog/defrost counter 38 and if the delog $defrost_{count}$ has been exceeded, the delog/defrost cycle may be initiated at step 66. In a manner similar to known delog/defrost cycles, the delog/defrost cycle initiated at step 66 is configured to warm the components of the freezer unit 10, such as the evaporator 18, to facilitate melting of ice which may have formed on the components and/or to protect system oil conditions. This delog/defrost cycle may further include a step to determine if sufficient time has elapsed to facilitate a sufficient drop in head pressure within the compressor 20.

At step 68, it is determined if sensor measurements associated with the environment within the cabinet 16 are being received. For example if a voltage reading across the cabinet sensor 24 is less than 1 millivolt ("mV") or greater than 130 mV, it may be determined that the sensor 24 has failed and thus, no reasonable temperature may be correlated with measurements from sensor 24. If the cabinet sensor 26 has also failed, it may thus be determined that the controller 28 is not receiving measurements associated with the environment within the cabinet 16. If sensor measurements associated with the environment within the cabinet 16 are being received and correlate to reasonable temperatures, the compressor 20 may be modulated by the controller 28 in normal operating mode at step 70. If, at step 68, it is determined that sensor measurements associated with the environment within the cabinet 16 are not being received or in error, the log 34 may be accessed at step 72.

At step 74, it is determined if logged operations within the log 34 are within the predetermined range of compressor operations. In other words, the logged operations are evaluated against the predetermined range of compressor operation. If the logged operations are within the predetermined range of compressor operations, the compressor 20 may be modulated by the controller 28 based on the logged operations at step 76. If the logged operations are outside of the predetermined range of compressor operations, the compressor 20 may be modulated by the controller 28 based on the default operations at step 78. Following the modulation of the compressor 20 at steps 76 or 78, it may be determined if sufficient time has elapsed to facilitate a sufficient drop in head pressure within the compressor 20 at step 56.

At step 70, the controller 28 may modulate the compressor 20 according to a normal mode. This normal mode is generally configured to facilitate maintaining the temperature in the cabinet 16 within a predetermined range of the $T_{set}$. In this regard, the controller 28 modulates the compressor 20 based on measurements transmitted or forwarded by the cabinet sensors 24 and/or 26. These compressor modulations are also stored to the log 34. In this manner, the log 34 is updated and maintained with current compressor operations.

At step 80, it is determined if an event has occurred. For example, if the door sensor 44 transmits a door open and/or close event to the controller 28, it may be determined that an event has occurred. If it is determined that an event has not occurred, it may be determined if sufficient time has elapsed to facilitate a sufficient drop in head pressure within the compressor 20 at step 56.

If, at step 80, it is determined that an event has occurred, an event mode of operation may be initiated at step 82. In this event mode, compressor operations utilized to substantially maintain or return the temperature within the cabinet 16 at the $T_{set}$ are associated with the event and stored to the log. For example, if controlling the compressor 20 to remain on for 1 hour is sufficient to return the cabinet to the $T_{set}$ following a door open/close event, the controller 28 may associate this duty cycle with the door open/close event and save it to the log 34. In this manner, should the door be opened and closed during a cabinet sensor 24 and 26 failure, a response based upon previous compressor operations may be utilized to control the compressor at step 76. In another example, if a duty cycle of 19 minutes on and 8 minutes off is utilized to maintain the $T_{set}$ when the ambient temperature is 26° C., this duty cycle may be stored to the log 34 with the associated ambient temperature of 26° C.

The above description and drawings are only illustrative of preferred embodiments which achieve the objects, features, and advantages of the present invention, and it is not intended that the present invention be limited thereto. Any modification of the present invention which comes within the spirit and scope of the following claims is considered to be part of the present invention.

What is claimed is:

1. A method of controlling a compressor, comprising the steps of:

generating a compressor operation log;

storing the compressor operation log;

selecting a compressor operation in response to a sensor failure, wherein the compressor operation is selected from the compressor operation log; and modulating the compressor according to the selected compressor operation in response to the sensor failure;

controlling the compressor in response to a delog operation dependent on a delog counter, wherein the delog counter is configured to initiate a delog cycle in response to a predetermined elapsed delog time.

2. The method according to claim 1 wherein the step of selecting the compressor operation further comprises:

evaluating the compressor operation log against a predetermined range of compressor operations; and setting a default compressor operation as the selected compressor operation in response to the compressor operation log being outside the predetermined range of compressor operations.

3. The method according to claim 1, further comprising controlling the compressor in response to a defrost operation dependent on a defrost counter, wherein the defrost counter is configured to initiate a defrost cycle in response to a predetermined elapsed defrost time.

4. The method according to claim 1, further comprising controlling the compressor in response to a short cycle operation dependent on a short cycle counter, wherein the short cycle counter is configured to substantially prevent modulation of the compressor in response to a predetermined elapsed short cycle time.

5. The method according to claim 1, further comprising activating an alarm system in response to the sensor failure.

6. The method according to claim 1, further comprising:

associating an event with a compressor operation;

storing the event and the associated compressor operation in the compressor operation log; and controlling the compressor to modulate according to the associated compressor operation in response to another occurrence of the event.

7. The method according to claim 6, wherein the event includes a door open event.

8. An apparatus comprising:

a refrigerant compressor;

a memory configured to store compressor data associated with controlling the compressor;

a first sensor configured to transmit measurements associated with environmental conditions within a cabinet; and a controller operatively connected to the compressor, the memory and the first sensor, wherein in response to a failure of the first sensor the controller is configured to modulate the compressor according to the compressor data; and a delog counter configured to initiate a delog cycle in response to a predetermined elapsed delog time, the delog counter being operably connected to the controller, wherein the controller is further configured to modulate the compressor based on a delog operation in response to the delog counter.

9. The apparatus according to claim 8, further comprising a relay operably disposed between the controller and the compressor, wherein the relay is configured to modulate a relatively high current associated with the compressor in response to a relatively low current received from the controller.

10. The apparatus according to claim 8, wherein the controller is further configured to evaluate the data against a predetermined range of compressor operations and modulate the compressor based on a default compressor operation in response to the data being outside the predetermined range of compressor operations.

11. The apparatus according to claim 8, further comprising a defrost counter configured to initiate a defrost cycle in response to a predetermined elapsed defrost time, the defrost counter being operably connected to the controller, wherein the controller is further configured to modulate the compressor based on a defrost operation in response to the defrost counter.

12. The apparatus according to claim 8, further comprising a short cycle counter configured to substantially prevent modulation of the compressor in response to a predetermined elapsed short cycle time, the short cycle counter being operably connected to the controller, wherein the controller is further configured to modulate the compressor in response to the short cycle counter.

13. The apparatus according to claim 8, further comprising an alarm configured to provide a capacity of notifying a user to an alarm condition, the alarm being operatively connected to the controller, wherein the controller is configured to activate the alarm in response to sensor failure.

14. The apparatus according to claim 8, further comprising a second sensor configured to transmit door readings associated with a door to the controller, wherein the controller is configured to associate the door readings with the compressor data and store the associated door readings with the compressor data to the memory in response to the first sensor being functional.

15. The apparatus according to claim 14, wherein the controller is configured to modulate the compressor according to the compressor data associated with the door reading in response to another occurrence of the door reading and failure of the first sensor.

16. The apparatus according to claim 8, further comprising a third sensor configured to transmit ambient measurements associated with ambient environmental conditions to the controller, wherein the controller is configured to associate the ambient measurements with the compressor data and store the associated ambient measurements with the compressor data to the memory in response to the first sensor being operational.

17. The apparatus according to claim 16, wherein the controller is configured to modulate the compressor in response to the compressor data associated with the ambient measurements in response to further ambient measurements and failure of the first sensor.

18. An apparatus comprising:

means for generating a compressor operation log;

means for storing the compressor operation log;

means for selecting a compressor operation in response to a sensor failure, wherein the compressor operation is selected from the compressor operation log;

means for modulating the compressor according to the selected compressor operation in response to the sensor failure; and means for controlling the compressor in response to a delog operation dependent on a delog counter, wherein the delog counter is configured to initiate a delog cycle in response to a predetermined elapsed delog time.

19. The apparatus according to claim 18, wherein the means for selecting the compressor operation further comprises:

means for evaluating the compressor operation log against a predetermined range of compressor operations; and means for setting a default compressor operation as the selected compressor operation in response to the compressor operation log being outside the predetermined range of compressor operations.

20. The apparatus according to claim 18, further comprising:

means for controlling the compressor in response to a defrost operation dependent on a defrost counter, wherein the defrost counter is configured to initiate a defrost cycle in response to a predetermined elapsed defrost time.

21. The apparatus according to claim 18, further comprising means for controlling the compressor in response to a short cycle operation dependent on a short cycle counter, wherein the short cycle counter is configured to substantially prevent modulation of the compressor in response to a predetermined elapsed short cycle time.

22. The apparatus according to claim 18, further comprising means for activating an alarm system in response to the sensor failure.

23. The apparatus according to claim 18, further comprising:

means for associating an event with a compressor operation;

means for storing the event and the associated compressor operation in the compressor operation log; and means for controlling the compressor to modulate according to the associated compressor operation in response to another occurrence of the event.

24. The apparatus according to claim 23, wherein the means for associating an event further includes a means for associating a door open event.

* * * * *